US005127549A

United States Patent [19]

Merritt et al.

[11] Patent Number: 5,127,549

[45] Date of Patent: Jul. 7, 1992

[54] NOZZLE ASSEMBLY FOR A FILLING MACHINE

[75] Inventors: Robert D. Merritt, Rossville; Stanley A. Groom, Hoopeston, both of Ill.

[73] Assignee: FMC Corporation, Chicago, Ill.

[21] Appl. No.: 451,395

[22] Filed: Dec. 15, 1989

[51] Int. Cl.[5] ..... G01F 11/00

[52] U.S. Cl. ..... 222/80; 222/256; 222/275; 141/249; 141/258

[58] Field of Search ..... 222/256, 275, 334, 339, 222/80, 309, 262, 333; 83/582, 588, 639.1; 239/114, 115; 141/147, 181, 249, 258, 280, 284

[56] References Cited

U.S. PATENT DOCUMENTS 1,956,074 4/1934 Krause ..... 222/256
2,299,003 10/1942 Baldwin ..... 226/96
3,563,168 2/1971 Doninger ..... 141/249
3,865,281 2/1975 Byrd et al. ..... 222/252
4,257,292 3/1981 Faull ..... 83/588
4,666,067 5/1987 Torterotot ..... 222/262

*Primary Examiner*—Donald T. Hajec
*Assistant Examiner*—Anthoula Pomrening
*Attorney, Agent, or Firm*—Ronald C. Kamp; R. B. Megley

[57] ABSTRACT

A piston-type multi-station rotary filling machine having improved reliability and consistency of operation. The filling machine includes a nozzle assembly for a filler with a product port which includes a nozzle body with a rectangular nozzle that intersects the product port. A plunger having a complementary rectangular cross-section and with a knife edge on the side adjacent to the port is reciprocably mounted within the nozzle. The knife edge cleanly cuts tough food products to facilitate accurate dispensing of the food products.

4 Claims, 3 Drawing Sheets

NOZZLE ASSEMBLY FOR A FILLING MACHINE

This invention relates to filling machines or fillers generally, and more particularly to such machines which are commonly called piston fillers.

Piston fillers are used to deposit a predetermined volume of food product into containers. Such piston fillers are often incorporated into multi-station, rotary machines which operate at high speeds, filling cans or containers at rates as high as 400 containers per minute. At such speeds an individual piston filler would typically experience millions of cycles per year. The resultant wear requires frequent adjustment and replacement of certain parts. The product being dispensed by the filler, particularly pet foods which can be tough and sinewy, often cause excessive wear and do not readily allow a clean cut, which in high speed machines particularly can cause contamination of the sealing edges resulting in defectively sealed packages.

The present invention overcomes or minimizes many of the deficiencies in prior art piston fillers mentioned above. Specifically, the present invention provides a piston filler which reduces the mechanical components subject to wear required for control of the filling cycle, which reduces or simplifies the adjustments needed to compensate for wear or for variation in the volume of food dispensed, which is capable of cleanly cutting tough and sinewy products, which have a relatively long operating life even when dispensing products of that type, and which is reliable and consistent. These and other objects of the present invention, and many of the attendant advantages thereof, will become more readily apparent from a perusal of the following description of a preferred embodiment and the accompanying drawings, wherein:

Figure 1:
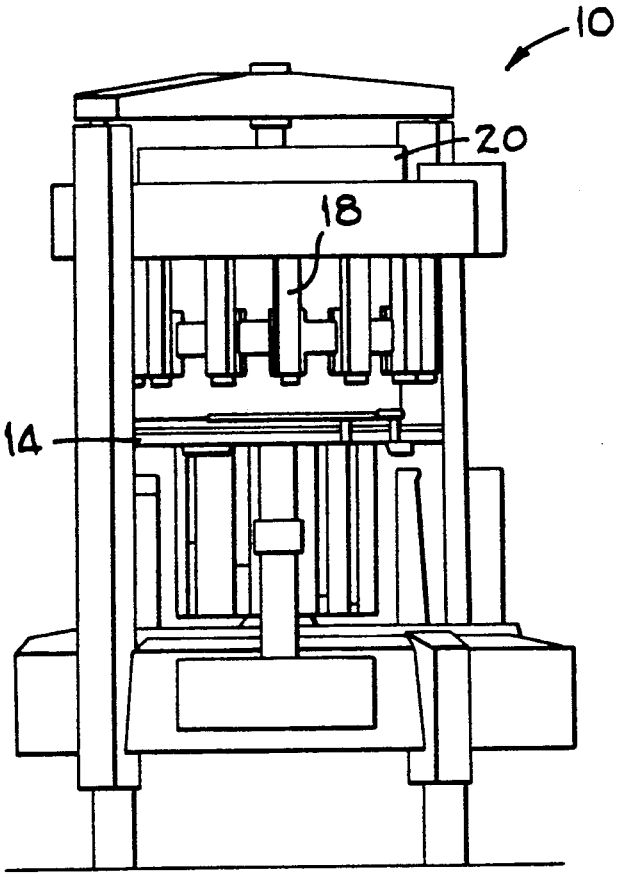
FIG. 1 is an elevational view of a rotary filler incorporating the present invention.
Figure 2:
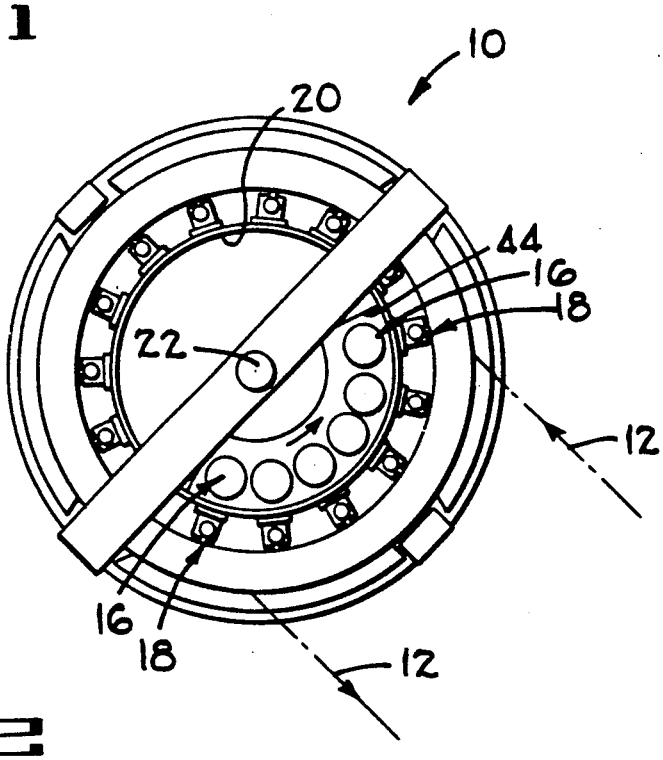
FIG. 2 is a top plan view of the filler shown in FIG. 1.

Referring to FIGS. 1 and 2, there is shown a piston-type multi-station rotary filler, indicated generally at 10, to which a stream of containers are supplied by an appropriate chain, represented by the line 12, trained over a sprocket 14 on the filler 10. Each station on the filler 10 includes a piston mechanism 16 and an associated cut-off nozzle mechanism 18. A hopper 20, which holds a supply of the food to be dispensed, is provided on the filler 10. The interior portion of the filler 10, including the hopper 20, the piston mechanism 16, and the cut-off nozzle mechanism 18 rotates about the vertical axis 22 driven either by the chain 12 or by a motor, which in turn would drive the chain 12. The chain 12 positions a container under each of the cut-off nozzle mechanisms 18 for receipt of the product dispensed therefrom. The dispensing of the product is basically the same as employed by prior piston fillers. Product in the hopper 20 is drawn into each fill cylinder or pocket 40 during retraction of the fill piston 42. As the filler rotates counterclockwise, as viewed in FIG. 2, the fill cylinder is covered by the cut-off plate 44. As the filler interior continues to rotate with the fill cylinders 40 covered by the cut-off plate 44, the fill piston 42 is extended to force product in the cylinder 40 to be pushed out of the nozzle 46 via the port 48, as best illustrated schematically in FIG. 6. When the fill piston 42 has completed its extension stroke, the nozzle plunger 70, which has previously been retracted, is extended to complete the dispensing of a measured volume of product into a container carried by the chain 12 and positioned below the nozzle 46.

Figure 3:
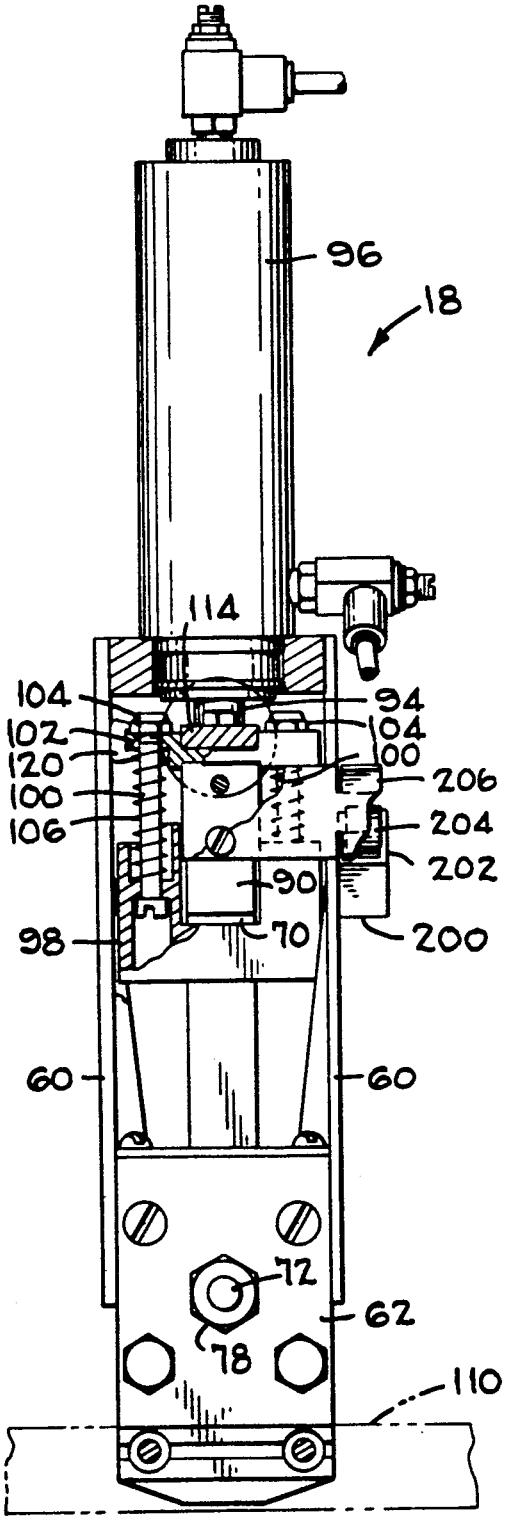
FIG. 3 is an elevational view, partly in section, of a cut-off nozzle arrangement utilized in the filler of FIGS. 1 and 2.
Figure 4:
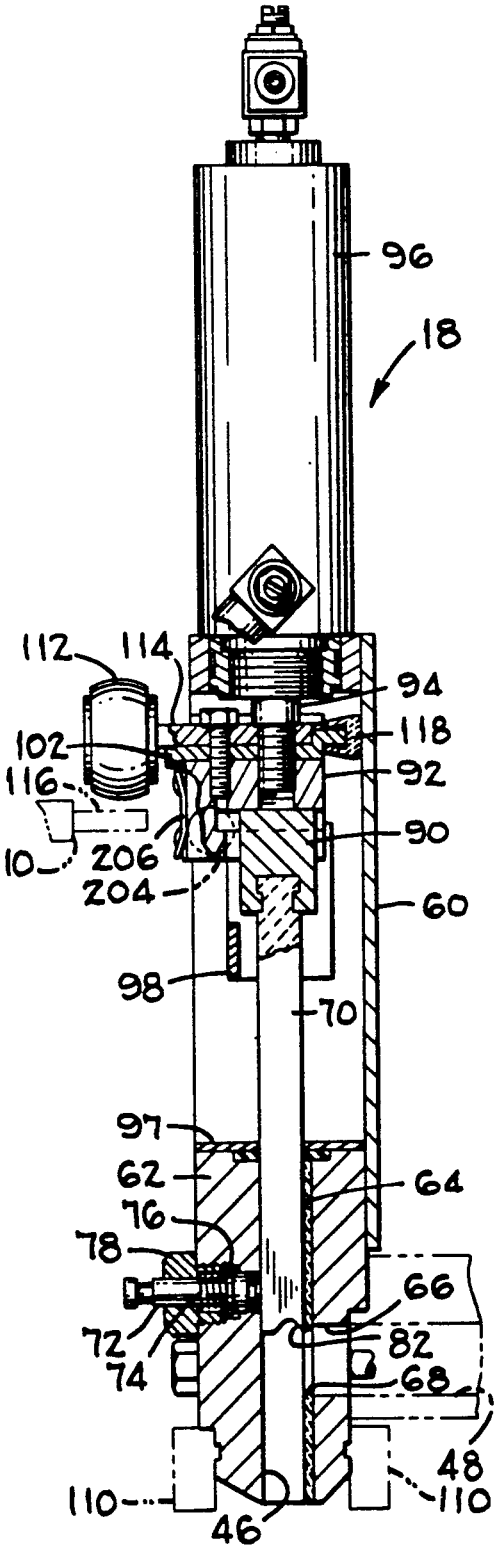
FIG. 4 is a view of the cut-off nozzle arrangement shown in FIG. 3 mostly in section taken on a vertical plane along the central axis thereof.

The cut-off nozzle mechanism 18 of the present invention is shown in FIGS. 3 and 4 and includes a frame 60 which is supported from and rotates with the interior of the filler 10. A nozzle body 62, in which a nozzle 46 is formed, is attached to the lower end of the frame 60. The nozzle 46 is rectangular in cross section and has a wear plate 64, preferably made of a ceramic material, forming the side adjacent the port 48. Aligned holes 66 and 68 formed in the nozzle body 62 and wear plate 64 respectively communicate with the port 48. The hole 68 in the wear plate 64 has a smaller inner diameter to discourage liquid from flowing from the port 48 into the nozzle 46. A plunger 70 having a rectangular cross-section complementary to the nozzle cross-section is reciprocably mounted in the nozzle. The plunger 70 is also made of a ceramic material, such as zirconia. A force pin 72 is positioned in a bore in the nozzle body 62 opposite the wear plate 64. A compression spring 74 is trapped between a flange 76 formed on the pin 72 and a retainer 78 engaging a threaded counter bore. The spring 74 forces the inner end of the pin 72 into engagement with the plunger 70 urging the plunger against the wear plate 64.

Figure 5:
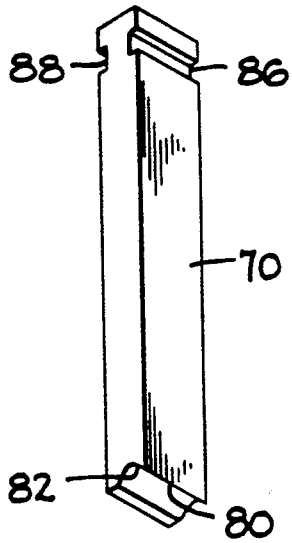
FIG. 5 is a pictorial view of the plunger used in the arrangement shown in FIGS. 3 and 4.

The plunger 70, as shown in FIGS. 4 and 5, is provided with knife edge 80 formed by the intersection of the side of the plunger adjacent the hole 68 in the wear plate 64 with a surface 82 formed on the lower surface of the plunger 70 at an angle to the aforementioned plunger side. The knife edge 80 makes a clean cut of any stringy or sinewy material that may extend from the port 48 as the plunger is extended. The force of the spring 74 exerted through pin 72 maintains the plunger 70 in tight engagement with the wear plate 64 to further enhance the ability of the knife edge 80 to make a clean cut as it passes the hole 68. Since ceramic has good wear characteristics, the life of the plunger 70 and the wear plate 64 is not appreciably affected by the side load imposed by the spring 74 through the pin 72, while the cutting action is enhanced thereby.

The upper end of the plunger 70 has channels 86 and 88 formed on sides thereof adjacent the pin 72 and the wear plate 64 which mate with a complementary keyway formed in a plunger adapter 90, which is attached in a similar manner to a cylinder attachment lug 92. The lug 92 is attached to the rod 94 of a piston, not shown, reciprocable within a pneumatic cylinder 96 secured to the upper end of the frame 60. A plunger stop block 98 is supported from a plate 102 attached to the lug 92. The block 98 is supported by a pair of shoulder screws 100 extending through bores formed therein and engaging threaded holes formed in the plate 102. Lock nuts 104 engage the threaded ends of the screws 100 and compression springs 106 are trapped between the plate 102 and the stop block 98. The stop block 98 contacts the upper end of the nozzle body 62, or as shown in FIGS. 3 and 4, a seal retainer 97 secured to the upper end of the body 62, when the plunger 70 has reached to lower end of the nozzle body 62. Movement of the stop block 98 is thereafter arrested and the springs 106 are compressed as the plunger 70 is extended beyond the nozzle by the cylinder 96. The compressed springs 106 return the plunger 70 to a position within the nozzle body 62, but still covering the port 48, when both ends of the pneumatic cylinder are exhausted.

The plunger 70, when fully extended, protrudes below the lower end of the nozzle body 62. The springs 106 normally will retract the plunger 70 into the nozzle body 62. However, if the filler 10 is provided with a nozzle cleaner, a portion of which is shown at 110 but is more completely disclosed in U.S. patent application No. 07/375,647, filed Jul. 5, 1989, a protruding plunger would contact the cleaner manifold causing the plunger 70 to break. A redundant mechanical retraction is provided to assure that the plunger is retracted before the filler interior rotates to a point where the plunger could contact the cleaner manifold. A lift roller 112 is rotatably mounted on a plate 114 secured to the lug 92. The roller 112 would engage a cam, schematically illustrated at 116, if the plunger 70 is not already retracted into the nozzle body 62, to lift the roller 112, the plate 114 and the intermediate members to partially retract the plunger 70. The cam 116 is secured to the stationary portion of the filler 10 and is engaged by the roller 112 as the filler interior rotates. Wear strips 118 and 120 are provided on the sides of plate 102 and contact the frame 60 to resist the offset loading imposed by the engagement of the roller 112 with the cam 116, should such contact occur.

A valve 200 is attached to the frame 60 and has an actuating arm 202 with a roller 204 mounted on the end thereof. A valve actuating plate 206 is secured to the lug 92 and moves with the plunger 70. The valve 200 forms a part of the pneumatic logic control illustrated schematically in FIG. 6. The purpose for and function of valve 200 will be explained in connection with that circuit.

Figure 6:
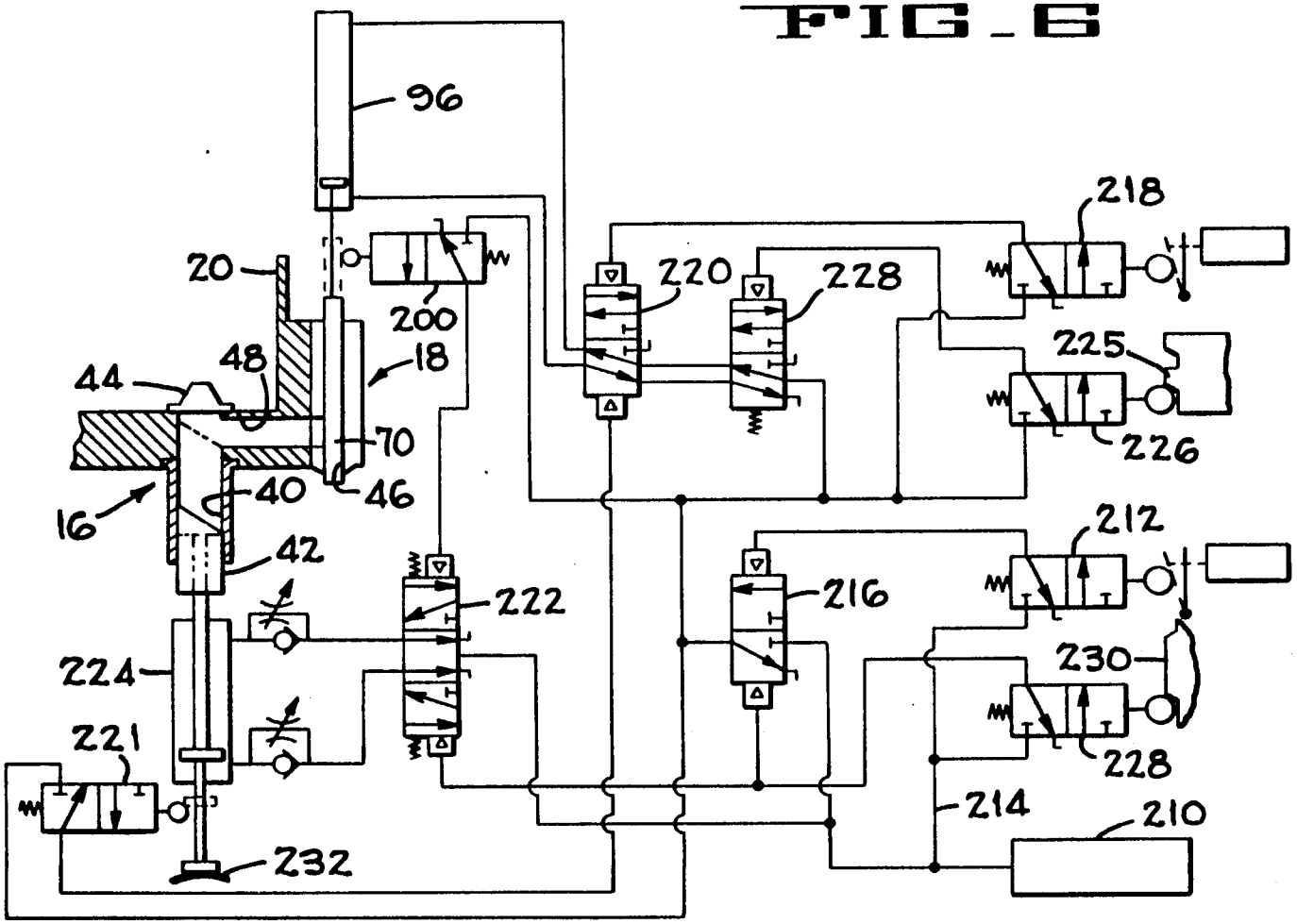
FIG. 6 is a schematic representation of the fluid control for the piston filler of FIGS. 1 and 2.

Referring to FIG. 6, air pressure must be provided through a rotary union 210 since the interior of the filler 20 is rotating about the axis 22. Air pressure is directed to the valve 212 through conduit 214 which is shifted to the left if a container is present at the associated fill station. When valve 212 is shifted to the left, air pressure is directed to shift the valve 216, which when shifted supplies air pressure to valve 218. Valve 218 is shifted to the left if a container is present at the associated fill station. Both of the valves 212 and 218 are no-container-no-fill valves and both must be shifted to the left, as shown in FIG. 6, in order to activate the fill cycle. Shifting the valve 216 also directs air pressure to the plunger valve 200 and the fill piston valve 221 which allows the fill cycle to begin. Shifted valve 218 directs air to shift valve 220 downward which when so shifted directs air pressure to the rod end of the plunger cylinder 96 while exhausting the head end thereof. The plunger 70 will thereby be retracted. The retracting plunger 70 shifts the valve 200 just as the fill port 48 is beginning to open. Valve 200 is thereby shifted to the right directing air pressure to shift valve 222 downward. When valve 222 is so shifted, air pressure will be directed to the lower end of the fill piston actuating cylinder 224 while the upper end thereof will be vented or exhausted. The fill piston 42 will be extended forcing product into the container. Valve 221 is shifted to the left when the fill piston 42 reaches the top of its stroke directing air pressure to shift valve 220 upward. Valve 220 when shifted upward, i.e., the position shown in FIG. 2, directs air pressure to the head end of the cylinder 96 extending the plunger 70. At this point in the cycle, the rotation of the filler interior causes a stationary cam 225 to shift valve 226 to the left directing air pressure to shift valve 228 downward. With valve 228 shifted downward, and valve 220 remaining in the position shown in FIG. 6 as previously described, air pressure will be directed for a few degrees of rotation to the rod end of the cylinder 96 causing the plunger 70 to cycle, i.e., retract, extend, retract and extend once again to ensure good product cut-off. With all fill cycle functions now complete, but with the container still under the nozzle body 62 and the fill pocket 40 no longer covered by the cut-off valve 44, a stationary cam 230 will shift valve 228 to the left directing air pressure to shift valve 216 to its upward position, as shown, and to shift valve 222 to its upward position. With valve 216 shifted to its upward or "start" position by the continued shifting of valve 228 by the cam 230, both ends of the cylinder 96 will be vented; the rod end through valves 220 and 228 and the head end through valves 220, 228 and 216, which will then permit the springs 106 to retract the plunger 70 within the nozzle body 62 but to still cover the port 48. Shifting the valve 228 by the cam 230 also directs air pressure to shift valve 222 upward. Valve 222 when so shifted, retracts the fill piston activating cylinder 224 to refill the product cylinder. After approximately 150 degrees of filler rotation, the cam 230 permits valve 228 to shift back to the right, which causes valve 222 to return to its center position. With valve 222 in its center position, both ends of the fill piston activating cylinder 224 are vented. An adjustable fill cam 232 may then raise the fill cylinder 224 to a selected height to provide the desired volume of product to be dispensed by the fill piston 42 into a container. The filler 10 is then ready to begin another fill cycle.

It will be appreciated from the foregoing description that the invention provides all of the attributes previously alleged. It will also be appreciated that various changes and modifications may be made without departing from the spirit of the invention as defined by the scope of the appended claims.

What is claimed is:

1. A nozzle assembly for a filler having a product port comprising:

a nozzle body having an essentially rectangular nozzle intersecting said port;

a plunger reciprocable within said nozzle and having a cross-section complementary to said nozzle;

a knife edge formed on the plunger on the side thereof adjacent said port; and bias means for urging said plunger against the side of said nozzle adjacent said port.

2. The invention according to claim 1 wherein said plunger is formed of a ceramic material.

3. The invention according to claim 2 and further comprising:

a wear plate secured in said nozzle body and forming the side of said nozzle adjacent said port.

4. The invention according to claim 3 wherein said wear plate is formed of a ceramic material.

* * * * *